US009737106B1

(12) United States Patent
Cannon, Jr.

(10) Patent No.: US 9,737,106 B1
(45) Date of Patent: Aug. 22, 2017

(54) METHOD AND APPARATUS FOR MITIGATING CONCUSSIONS

(71) Applicant: Thomas Calvin Cannon, Jr., Las Vegas, NV (US)

(72) Inventor: Thomas Calvin Cannon, Jr., Las Vegas, NV (US)

( * ) Notice: Subject to any disclaimer, the term of this patent is extended or adjusted under 35 U.S.C. 154(b) by 0 days.

(21) Appl. No.: 15/436,551

(22) Filed: Feb. 17, 2017

(51) Int. Cl.

| | |
|---|---|
| ***A42B 3/00*** | (2006.01) |
| ***A42B 3/06*** | (2006.01) |
| ***A42C 2/00*** | (2006.01) |
| ***A63B 71/10*** | (2006.01) |

(52) U.S. Cl.
CPC ..... *A42B 3/062* (2013.01); *A42B 3/06* (2013.01); *A42C 2/00* (2013.01); *A63B 71/10* (2013.01)

(58) Field of Classification Search
CPC ..... A42B 3/00; A42B 3/06; A63B 71/10
USPC ..... 2/411, 412, 425, 171
See application file for complete search history.

(56) References Cited

U.S. PATENT DOCUMENTS

| | | | | |
|---|---|---|---|---|
| 4,698,852 | A * | 10/1987 | Romero | A42B 3/00 2/171 |
| 9,060,558 | B2 * | 6/2015 | Dorman | A42B 3/0406 |
| 9,629,409 | B1 * | 4/2017 | Cannon, Jr. | A42B 3/062 |
| 2011/0302700 | A1 * | 12/2011 | Vito | A42B 3/14 2/412 |

* cited by examiner

*Primary Examiner* — Tejash Patel

(57) ABSTRACT

A method and apparatus for reducing the severity of blows delivered to protective headgear hard outer shells. The method consists of applying cushions to the hard outer shell, forcing the cushions to conform to the contour of the hard outer shell by laying straps over the cushions, applying tension to the straps, and holding the cushions in place by anchoring the straps at the front and rear of the hard outer shell. The apparatus consists of rectangular-shaped cushions, straps that lay atop the cushions, and a rear anchor strap whose ends attach on opposites sides of the front of the hard outer shell, and whose middle extends backward to provide anchor points for other straps in the system. A crown cushion runs over the crown of the hard outer shell and a side cushion wraps around the side of the hard outer shell with overlapping ends that anchor to themselves.

6 Claims, 5 Drawing Sheets

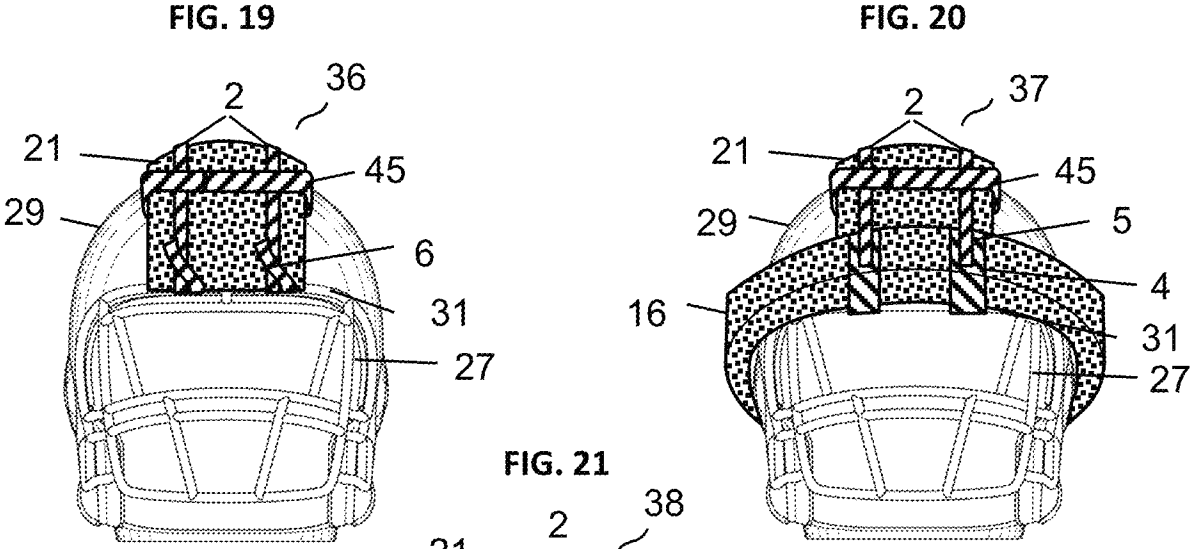
FIG. 19
FIG. 20
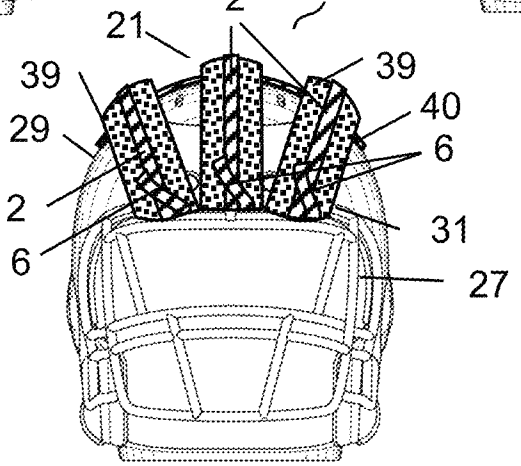
FIG. 21

METHOD AND APPARATUS FOR MITIGATING CONCUSSIONS

This invention relates to mitigating head concussions resulting from sharp blows delivered to protective headgear. More specifically, this invention relates to adding energy-absorbing cushions to the outside of protective headgear using methods and apparatus that allow such cushions to be universally installed on any headgear possessing a hard outer shell, without modifying the cushions, and without using clips, hooks, buckles, or adhesives. p Approximately 3.6 million individuals in the United States of America play football (comprising two thousand professionals, 12 thousand college students, 1.1 million high school students and 2.5 million youths). The very best current-day headgear is incapable of preventing their concussions, as acknowledged by the statement printed on each helmet sold: "WARNING: No helmet can prevent serious head or neck injuries a player might receive while playing football. Do not use this helmet to butt, ram or spear an opposing player. This is in violation of the football rules and such use can result in severe head and neck injuries, paralysis or death to you and possible injury to your opponent. Contact in football may result in CONCUSSION-BRAIN INJURY which no helmet can prevent." Thus there is a compelling need to advance the state of the art in headgear technology to better protect the large number of participants in football and other sports.

For most athletes the issue of providing better headgear has as much to do with affordability as it does with technology. The best present-day football helmets typically cost over $300 each. Incorporating additional injury-prevention technology into existing helmets could increase their cost to the point where helmets are unaffordable for the largest segment of users—youths. Accordingly, to benefit the largest number of users, the incremental cost of a safer helmet must be minimal. Further, the capital investments that institutions have made in their existing helmet inventories should be preserved, to the extent possible, to promote adoption of safer technology. Therefore, an ideal solution would be to greatly improve the effectiveness of all existing helmets while minimizing additional cost. This is a considerable challenge because of the ranges of different helmet designs and sizes.

Although cost is an important factor for most athletes, it is not a driving factor for professional athletes who typically earn millions of dollars a season. For professional athletes, effectiveness, minimal degradation of athletic performance, ease-of-use, and esthetics are most important—in roughly that order. (That said. Some football players opt not to wear rib pads, for example, because they feel pads might either slow them down or inhibit their movements.) Accordingly, to maximize acceptance, any new protective headgear must not only be effective, but also be as light as possible, easy to install and replace when damaged, and look good. The fact that over the past 50 years the football community has not adopted any changes in headgear that substantially reduce concussions (despite the numerous modifications proposed by inventors) is evidence that truly game-changing methods and apparatus have not been obvious to those skilled in the art.

The present invention describes a method and apparatus for enhancing all existing helmets to greatly reduce the incidence of concussions, using new methods and low-cost apparatus that may be installed, and removed, entirely by hand, without using clips, hooks, buckles, or adhesives. The keys are to (1) augment existing helmets with simple, low-cost external cushions capable off softening blows to helmets, (2) design the cushions so that they provide an optimum amount of coverage of the helmet, yet fit any size helmet without modification, and (3) devise novel installation methods and apparatus that allow the cushions to be quickly installed and removed without using clips, hooks, buckles, or adhesives.

BACKGROUND OF THE INVENTION

The U.S. Centers for Disease Control and Prevention estimates that 300,000 sports-related concussions occur yearly in the U.S., but that number includes only athletes who lost consciousness. Since loss of consciousness is thought to occur in less than 10% of concussions, the actual number is probably closer to 3 million a year. Further, half of these concussions occur in children age 0 to 14, and an addition 38% occur in the age group 15 to 34. Only recently has the extent of sports-related mild traumatic brain injury (MTBI) become known among the general public. In 2010 the University of Wisconsin University published a study in their *On Wisconsin* magazine that showed everyone who plays football or boxes for 10 years or more suffers permanent brain damage. However, individuals and organizations concerned with protecting sports participants have been pursuing better protective headgear since the early 1940s. Most of such efforts have focused on improving the cushioning inside the helmet's hard plastic shell. Those efforts are ongoing but, to date, no helmet claims to completely preclude concussions.

The laws of Physics limit the effectiveness of internal cushioning because of the limited space insides helmets. Current day football helmets weigh approximately four pounds and contain air cushions approximately one inch thick. The helmets fit over athletes' heads, which weighs, on average, 11 pounds. A sharp blow that causes a 100 g acceleration (g being the acceleration caused by gravity acting on a falling object, or 32.2 feet/sec$^2$) of the helmet cannot be reduced to a safe level with just one inch of padding. Further, the force delivered to the head can be amplified during "rebound" conditions. Such conditions occur when the athlete's head is already moving away from a sharp blow, and is suddenly met with a second force acting opposite to the direction of travel. This is exactly what happens when an athlete's head bounces off the ground. Such a traumatic collision was caught on film in 1960 when Philadelphia Eagle Chuck Bednarik tackled NY Giant Frank Gifford, causing a life-long head injury that caused Frank Gifford to miss the entire next professional football season. Concussions resulting from head collisions are now being treated as a serious issue.

Most concussion studies have focused on measuring head accelerations rather than devising ways of reducing accelerations. Companies and organizations have developed small accelerometers that players may ware to record the accelerations (linear and rotational) experienced during contact. Such data is useful in determining the acceleration levels that produce concussions, currently believed to be between 100 g and 150 g.

The National Operating Committee on Standards for Athletic Equipment (NOCSAE) has meticulously developed methodologies to test the ability of football headgear to limit head accelerations. Their principal test for football helmets consists of dropping a helmeted Headform (i.e. simulated head) onto a half inch thick polyurethane pad that measures the deceleration of the helmeted Headform. The tests prescribe a variety of impact velocities with the helmet oriented in different positions. Further, the NOCSAE has developed a measure of the severity of impacts, called the Severity Index (SI). The SI is defined as the integral of the instantaneous acceleration, A (expressed as multiples of the gravitational acceleration, g) raised to the 2.5 power, measured over the interval when A equals or exceeds 4.0. Mathematically, this becomes:

$$SI = \int_{t_1}^{t_2} A^{2.5} dt$$

where SI has units of seconds.

The NOCSAE prescribes limits on SI as a function of impact speed and point of impact on the helmet. As such, the Severity Index provides an objective measure of the protective value of helmets. For example, NOCSAE prescribes that the SI of a 17.94 foot/sec impact shall not exceed 1200 for any helmet impact orientation. (NOCSAE cautions that the 1200 SI value is just a threshold, stating "There is no measurable difference in safety of helmets with scores below the 1200 SI threshold. For example, a helmet scoring 400 SI isn't more likely to reduce injury than one scoring 800 SI. Once the SI value gets below approximately 800 to 900, the change to the risk of injury is essentially immeasurable.")

While prior designs that only employ cushioning material on the inside of the helmet can meet NOCSAE requirements, they cannot guarantee protection against concussions. Accordingly, investigators have looked at adding cushioning material on the outside of the helmet. In particular, Alfred Pettersen (US Patent 20150000013A1) invented an exterior sport helmet pad that was formed to fit over the helmet, and was held in place by internal contact pressure. Although such a cushioning device may provide some additional protection, it would be prohibitively expensive because a separate mold would be required for each size of each helmet design. Further, covering the entire outer surface of the helmet with extra padding could make the helmet excessively heavy, and thereby adversely affect athletic performance. In addition, Pettersen's conclusion that a pad thickness of only 0.5 to 0.75 inches thick was sufficient to mitigate concussions was unfounded because his tests did not conform to NOCSAE specifications. In particular, Pettersen's top impact speed was 8.97 feet/sec, which is below the minimum test speed of 11.34 feet/sec prescribed NOCSAE, and well below the NOCSAE maximum test speed of 17.94 feet/sec. Finally, Pettersen did not report the Severity Index for any test (as required by NOCSAE), but rather reported the amount that his external padding reduced the peak acceleration. Although Pettersen described the NOCSAE helmet tests within his patent, he gave no indication that any such tests were actually performed as specified.

Cannon et al. (U.S. patent application Ser. No. 15/156,537) developed an analytical model of the dynamics governing helmet impact which could be used to methodically design a cushioning system capable of mitigating concussions. Their analysis showed that external cushions having thicknesses between 0.5 inches and 1.0 inches can reduce the Severity Index an order of magnitude below the NOCSAE threshold of 1200, provided the elastic modulus (E) of the cushions lay in the range between 120 psi to 240 psi. Several commercially-available polymer foam materials have elastic properties that lie within this range and therefore can be used to construct cushions to protect the hard outer shells of headgear. In particular, open cell foam materials are preferable to closed cell foam materials because open cell foams dissipate more energy than closed cell foams. (In fact, the equations developed by Cannon et al. show that closed-cell foams and air cushions dissipate less energy than a football helmet's hard outer shell, thereby resulting in more rebound after impact. This undesirable effect was confirmed in physical tests.)

Since it has been established that energy-absorbing cushions applied to the hard outer shells of headgear can reduce the severity of accelerations transmitted to the wearer's head, the remaining challenge is optimize the cushion design and installation methods to maximize performance and acceptance, at an affordable cost. Cannon et al. (U.S. patent application Ser. No. 15/156,537) devised a system of cushions to protect the hard outer shell of headgear that was inexpensive to fabricate and could be installed onto any model and size of headgear. Although the system completely protected the crown of the headgear, it did not provide continuous 360 degree protection around the sides of the headgear. This is significant because blows can come from any direction during athletic competition. Also, the Cannon et al. system relied upon hooks and clips to affix the cushions to the headgear. This can be an issue because the thickness of the hard outer shell of headgear varies along its edge, thereby necessitating different size clips and hooks to attach the cushions to the headgear. This is particularly challenging for the rear edge of the hard outer shell which is typically covered by a rear rubber pad that protects the back of the wearer's neck. The presence of the rear rubber pad makes it difficult to securely attach a clip or hook to the rear of the hard outer shell without disturbing the rear rubber pad. Also, the presence of a hard clip or hook in the vicinity of the wearer's neck can constitute a safety hazard. Finally, it's possible for clips and hooks to be dislodged by violet blows to the headgear.

The present invention builds on the work of Cannon et al. by devising a system of cushions that provide full 360 degree protection around the circumference of the headgear, and which can be installed without using clips, hooks, buckles, or adhesives.

BRIEF SUMMARY OF THE INVENTION

A method and apparatus for improving the effectiveness of protective headgear by securely attaching cushions to the outside of the headgear without using clips, hooks, buckles, or adhesives. The cushions are rectangular-shaped pieces of energy-absorbing material that are anchored to the headgear using self-engaging straps. The cushions are forced to conform to the headgear by straps that sandwich the cushions around the curved hard outer shell of the headgear. Hence the method and apparatus can be applied to any helmet shape or size. A crown cushion runs over the crown of the headgear, from front to back. Arc cushions run over the top half of the headgear, from back to front, along planes offset from that of the crown cushion. A side cushion has tapered ends, and wraps completely around the side of the headgear with some amount of overlap. All of the cushions may be used independent of one another or in combinations. A key component is the rear anchor strap, whose ends attach to opposite sides of the lower front of the headgear, and whose middle section extends toward the back of the headgear, thereby providing a means for securing cushions and other straps at the rear of the headgear.

BRIEF DESCRIPTION OF THE DRAWINGS

FIG. 19 gives a frontal view of a crown cushion mounted onto a football helmet using a rear anchor strap (not visible), an overlapping loop, and lengthwise straps having twisted loops.

FIG. 20 gives a perspective view of a side cushion and a crown cushion mounted onto a football helmet using a rear anchor strap (not visible), overlapping loops, and lengthwise straps having twisted loops.

FIG. 21 shows a crown cushion and two arc cushions mounted on a football helmet, and stabilized atop the helmet by a friction patch.

DETAILED DESCRIPTION OF THE INVENTION

Figure 1:
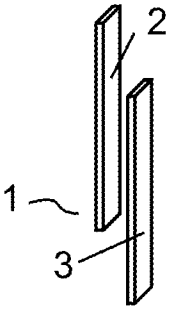
FIG. 1 shows two overlapping straps.

The present invention secures cushions to the hard outer shell of protective headgear by only using straps that are attached to "anchor points" located at the front, sides, and rear of the hard outer shell. For brevity, the word "headgear" will be used interchangeably with "protective headgear" throughout this document.

There are two types of cushions: (1) "top cushions" that run from back to front over the top half of the hard outer shell and protect the top half of the hard outer shell, and (2) a "side cushion" that wraps around the side of the hard outer shell with overlapping tapered ends that anchor onto themselves, and protects the sides of the hard outer shell. All of the cushions have planar elongated rectangular shapes in their unstressed states. The cushions' major, minor, and intermediate dimensions are referred to as its "length," "thickness," and "width," respectively. An important aspect of the present invention is that the cushions do not have to be molded or cut into special shapes (requiring special equipment and costly fabrication processes), but rather can be inexpensively cut from large slabs of bulk material by only using straight-cut saws, thereby saving production costs and materials cost.

"Anchor points" are defined as points, or elements, where straps can be secured to the hard outer shell, or to other straps that are already secured to the hard outer shell. Hence, a strap that is already attached to the hard outer shell can provide anchor points for other straps. Examples of frontal anchor points include the facemask, holes through the helmet, and other elements installed by the manufacturer on the hard outer shell, such as chin strap lugs. However, since the hard outer shells of commercially-available headgear generally do not come equipped with extra lugs, the present invention does not rely on lug anchor points. Instead, the preferred frontal anchor points are members of the headgear facemask. Frontal anchor points lie along horizontal elements near the top middle of the facemask and along lower elements on opposite sides of the facemask.

The straps may consist of any material that is flexible in the lateral direction, yet stiff in the longitudinally, such as the material in common clothes belt, for example. Further, although strap ends must be capable of latching onto to other objects and to themselves. Using knots or buckles as latching mechanisms is possible, but not preferred, because tying knots and employing buckles can be costly, time-consuming, and dangerous to individuals who might come in contact with them. Accordingly, the preferred embodiment of the strap is one whose opposite sides feature mating "hooks" and "loops" materials that allow opposite sides of the strap to latch together, or "self-engage." The first strap that incorporated hooks and loops material was produced by VELCRO®. The original VELCRO® straps consisted of two separate straps, one possessing fabric "loops" and the other possessing fabric "hooks." Such VELCRO® straps are referred to as single-sided straps. The hooks and loops engage one another when the two straps are pressed together, thereby making the joint resistant to tensile forces applied to the ends of the mating straps. Such straps are still in use. In addition, "self-engaging" straps are available in which hooks are incorporated on one side and loops are incorporated on the other side, thereby giving the strap the ability to latch onto itself, or making the straps self-engaging. Self-engaging straps simplify and quicken the process of securing cushions to headgear by forming the self-engaging straps into configurations such as (1) "overlapping loops" wherein opposite ends of the same strap latch onto one another, and (2) "twisted loops" wherein a single strap end is twisted about the straps longitudinal axis and then looped back to latch one side of the strap to its opposite side. For example, a self-engaging VELCRO® strap may be attached to a headgear's facemask via a "twisted loop" by wrapping an end of the strap around an element of the facemask, then twisting the strap end about its longitudinal axis so that the straps self-engaging surfaces mate together when the end of the strap is looped back toward the untwisted portion of the strap, then pressed against the untwisted segment of the strap to form a secure connection.

FIG. 1 through FIG. 7 show various configurations for latching straps to other objects, and onto themselves. More specifically, these various components may be used to attach straps to cushions, anchor points residing on the hard outer shell of headgear, other straps, and onto themselves. The configurations depicted in FIG. 1 through FIG. 4 are generally preferred over those depicted in FIG. 5. thru FIG. 7 because of their versatility, simplicity, ease-of-use, cost, and safety. FIG. 1 is an exploded view of an "overlapping joint" 1 wherein a first strap 2 overlaps a second strap 3 and the two straps latch onto one another when pressed together. An overlapping joint can be made with single-sided VELCRO® straps, self-engaging VELCRO® straps, or a combination of the two.

Figure 2:
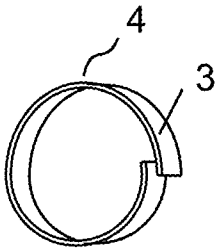
FIG. 2 shows a single strap formed into an overlapping loop.

FIG. 2 shows a single strap 3 formed into an "overlapping loop" 4. The overlapping loop 4 is useful for latching cushions to anchor points wherein both the minor cross section of the cushion and the anchor point are surrounded by the overlapping loop 4. The overlapping loop 4 can also be used to create an anchor point on an elongated rectangular-shaped cushion wherein the overlapping loop 4 is wrapped around the minor cross section of the elongated rectangular-shaped cushion, thereby allowing straps to be attached to the elongated rectangular-shaped cushion by engaging the overlapping loop 4.

Figure 3:
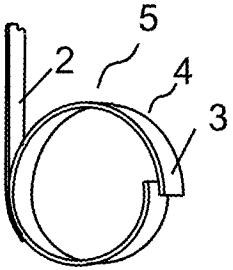
FIG. 3 shows a strap, formed into an overlapping loop, and mated to the end of a connector strap.

FIG. 3 shows a "loop-and-strap-assembly" 5 consisting of a strap 3, formed into an overlapping loop 4, and mated to the end of another strap 2. In this configuration the overlapping loop 4 serves as the anchor point for the strap 2.

Figure 4:
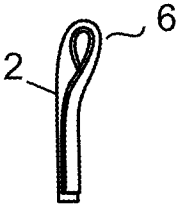
FIG. 4 shows a strap whose end is formed into a twisted loop that allows the bottom side of the strap to lay against the top side of the strap.

FIG. 4 shows a strap 2 whose end is formed into a "twisted loop" 6 that allows the bottom side of the strap 2 to lay against the top side of the strap 2. The twisted loop 6 so created can be used to attach the strap 2 to a variety of anchor points, including anchor points residing on the hard outer shell of headgear, and anchor points along other straps.

Figure 5:
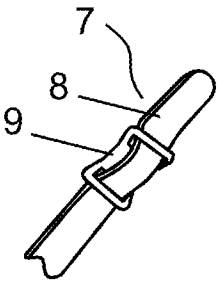
FIG. 5 shows a lug buckle mounted onto a chin strap.

FIG. 5 shows a chin strap assembly 7 consisting of a lug buckle 9 mounted onto a chin strap 8. The hidden side of the lug buckle 9 is configured to snap onto lugs (not shown) installed onto the hard outer shell of headgear. As previously stated, although a lug buckle 9 is one way of anchoring straps to the hard outer shell of headgear, it is undesirable to do so because (1) it requires modifying the headgear, and (2) the buckle can unlatch when subjected to large impacts.

Figure 6:
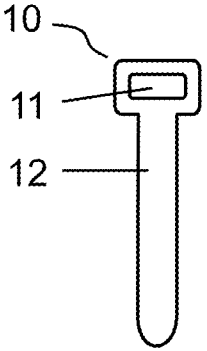
FIG. 6 shows a strap having a hole through it at one it.

FIG. 6 shows a "cinch strap" 10 consisting of a strap 12 with a hole 11 at one end that is wide enough to allow the narrow portion of the strap to pass through it. This feature allows a cinch strap 10 to encircle other objects, thereby making a quick and simple connection. The principal disadvantages of using a cinch strap 10 to latch onto anchor points on the hard outer shell of headgear are their relative high cost, and limited lengths. However, a cinch strap made of self-engaging material could be mated to another strap of self-engaging material, thereby forming an overlapping joint and extending the length of the assembly by an arbitrary amount. Accordingly, it is understood that a cinch strap (joined to another self-engaging strap when additional length is needed) can be used in any instance wherein a "twisted loop" is prescribed. For brevity, the single term of "twisted loop" is used for the remainder of this document to designate the type of connection that can be made by a single strap whose end twists to loop back and latch onto the opposite side of the strap, or the combination of a cinch strap made of self-engaging material, and another strap made of self-engaging material joined together through an overlapping joint.

Figure 7:
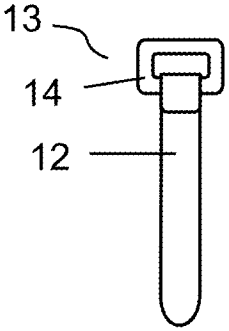
FIG. 7 shows a strap with a buckle.

FIG. 7 shows a "strap and buckle" assembly 13 in which a strap 12 is secured to a buckle 14. Although such an assembly may be used to latch onto anchor points on the hard outer shell of headgear, it has the disadvantages of being relatively costly and available in limited lengths. Further, a hard buckle 14 can present a safety hazard.

Figure 8:
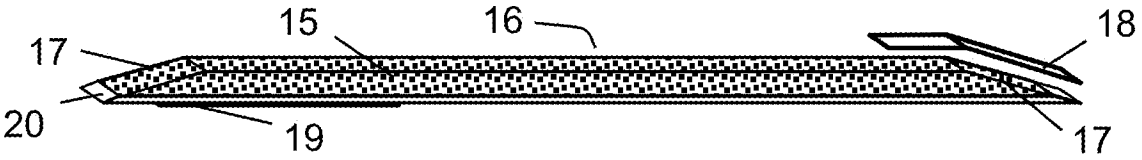
FIG. 8. shows an elongated rectangular-shaped cushion having tapered ends, a skin, and mating surfaces that adhere to one another.
Figure 9:
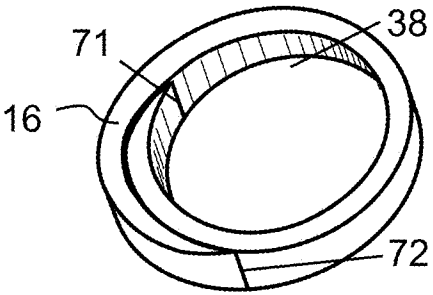
FIG. 9 shows a side cushion formed into a loop with overlapping ends.

The sides of the hard outer shell should be protected around its entire perimeter because strong blows can come from any direction. Such protection can be provided by a "side cushion" that is planer in its unstressed state, as depicted in FIG. 8, but wraps completely around the side of the hard outer shell, with some amount of overlap of, as depicted in FIG. 9. FIG. 8. shows a side cushion 16 consisting of an elongated rectangular-shaped, flexible piece of energy-absorbing material 15 having two tapered ends 17. The overlapping ends of the side cushion 16 are tapered to avoid abrupt corners that might snag on other objects during athletic activities. For smooth transitions, the tapered segments 17 of the side cushion should be approximately three times the thickness of the side cushion, which translates into a taper angle of approximately 18.4 degrees. Thus a one-inch thick side cushion would have three inch long tapered ends, and the side cushion 16 would have to overlap itself by at least six inches to obtain a complete overlap of the one-inch thick portions of the side cushion 16. The tapered ends 17 latch together by means of two mating patches of hook and loop material, with a first patch 18 bonded along the taper of one end, and a second patch 19 bonded on the opposite side of the side cushion, near the opposite end. Optionally, the side cushion 16, as well as other cushions in the present invention, may include a skin 20 made of a material that is more durable than that of the cushion material 15 and whose purposes are to protect the cushion material 15 against abrasions and gouges, and make the outer side of the cushion water resistant. For example, the skin 20 may be made of durable elastic material such as EPDM, Neoprene, EVA, or Butyl rubber, and have thicknesses ranging from one to three millimeters.

Figure 17:
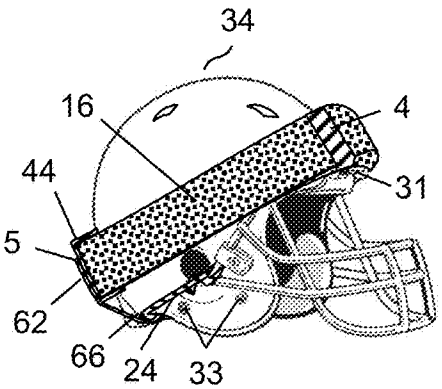
FIG. 17 gives a perspective view of a side cushion mounted onto a football helmet using a rear anchor strap, overlapping loops, and connector straps having twisted loops.

The side cushion 16 is oriented with its bottom edge lying along a plane defined by a horizontal line passing through the top of the frontal opening of the hard outer shell and a point in the middle of the extreme rear edge of the hard outer shell, as depicted in FIG. 17.

FIG. 9 shows a side cushion 16 formed into a loop 38 with overlapping ends. The loop should be sized to tightly fit over the hard outer shell of the headgear. A tight fit occurs when the inside diameter of the loop 38 is smaller than the outer perimeter of the hard outer shell, wherein the outer perimeter of the hard outer shell is measured along the plane defined by a horizontal line passing through the top of the frontal opening of the hard outer shell and a point in the middle of the extreme rear edge of the hard outer shell. To achieve a tight fit, the side cushion 16 may be loosely wrapped around the side of the hard outer shell (not shown) until the ends overlap, then marking a pencil mark on the edge of the side cushion 16 where the tip 71 of the innermost tapered end meets the overlapping outermost segment of the side cushion 16. The side cushion 16 is then removed from the hard outer shell and formed into a loop 38 that is slightly smaller than indicated by the pencil mark made on the edge of the side cushion 16. Since the side cushion 16 is removed from the hard outer shell, it is easy to press together the mating patches 18 and 19 depicted in FIG. 8. The looped side cushion 16 is then forced over the top of the hard outer shell, thereby creating a tight fit.

The amount that the tips 71 and 72 of the side cushion 16 overlap must be sufficient to allow the side cushion to fit all makes and sizes of headgear, ranging from Small (S) to Extra Large (XXL). Since most helmets are elliptically-shaped, equations for an ellipse can be used to calculate how much this extra overlap must be for the side cushion to fit all size headgear. This can be done using the relationship between an ellipse's perimeter, P, major radius, a, and minor radius, b. A good approximation to the perimeter of an elliptical figure was derived by Indian mathematician S. Ramanujan and is copied below:

$$P \cong \pi\left[3(a+b) - \sqrt{(3a+b)(a+3b)}\right]$$

However, since football headgear are only slightly elliptical (nearly circular), for the purposes of this analysis, the perimeter length can be approximated using the much simpler equation for a circle, given below:

$$P \cong \pi D$$

According to the above equation, a change in D amplifies the change in P by a factor or Pi ($\pi$), or approximately 3.14159. The difference in diameter of the largest and smallest hard outer shell of football headgear is approximately 1.625 inches. Accordingly, the extra overlap needed to accommodate this difference equals 3.14159 times 1.625 inches or approximately 5 inches. Hence for a 45-inch long side cushion, the total overlap for the smallest football headgear would equal 11 inches (6+5), while the overlap for the largest football headgear would equal 6 inches.

Figure 10:
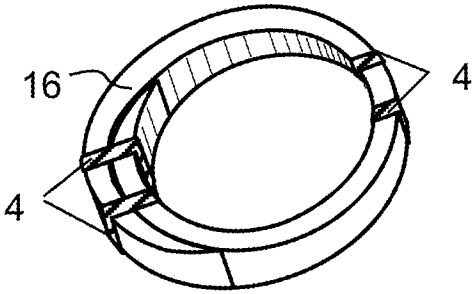
FIG. 10 shows a side cushion that has been formed into a loop, and has several overlapping loops wrapped around its cross section.

FIG. 10 shows a side cushion 16 outfitted with four overlapping loops 4. The overlapping loops 4 provide anchor points for other straps and are installed around the minor cross section of the side cushion 16 prior to mounting the side cushion 16 onto the hard outer shell.

Figure 11:
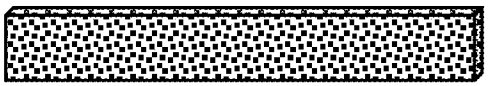
FIG. 11 shows an elongated rectangular-shaped cushion in its unstressed state.

FIG. 11 shows a "top cushion" 21 in its unstressed state, consisting of an elongated rectangular-shaped, energy-absorbing material. A special type of top cushion, called the "crown cushion," runs over the very top, or crown, of the hard outer shell, with its centerline lying in a vertical plane, as depicted in FIG. 19. All other top cushions are called "arc cushions" because they run along arcs that lie in planes displaced by some angles away from the vertical plane of the crown cushion, as depicted in FIG. 21. The crown cushion can be made wider than arc cushions because the curvature of the hard outer shell along the crown is less than that along arcs displaced from the crown. Top cushions are secured to the hard outer shell using lengthwise straps. A single top cushion consisting of crown cushion makes the protective headgear resemble a "Mohawk" haircut, as depicted in FIG. 19, giving it an edgy look, which some athletes and fans might like. Also, when used as the only cushion in the system, the crown cushion minimizes increases in the weight and cross sectional profile of the headgear, while preserving the space available on the sides of the headgear for team logos. An array of top cushions consisting of a crown cushion and arc cushions makes the protective headgear resemble the present day "Corn Row" hairstyle, as depicted in FIG. 21.

Figure 12:
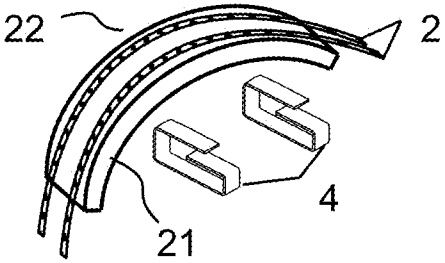
FIG. 12 shows an elongated rectangular-shaped cushion that has been formed into an arc by the tensile forces exerted by two lengthwise straps that run over its length, along with overlapping loop that can be wrapped around the assembly comprising the crown cushion and lengthwise straps, to secure the lengthwise straps in place.

FIG. 12 shows an assembly 22 consisting of an elongated rectangular-shaped top cushion 21 in the stressed, curved configuration that it assumes when forced over the headgear's hared outer shell by the tensile forces exerted by two lengthwise straps 2 that run parallel to the length of the top cushion 21. FIG. 12 also shows two overlapping loops 4 that can be wrapped around the minor cross section of the elongated rectangular-shaped top cushion 21 to lash the top cushion 21 and lengthwise straps 2 together, or to bind the top cushion 21 and lengthwise straps 2 atop the hard outer shell.

Anchor points are needed at the rear of the protective headgear to secure cushions at the rear of the protective headgear. The following paragraphs describe the mechanism for providing such anchor points that is referred to as the "rear anchor strap" 24, as depicted in FIG. 12. The simplest form of a rear anchor point might be a patch of glue that bonded the rear end of a strap to the rear edge of the hard outer shell. However, this approach would have the disadvantage of being permanent. Further, the bond strength of glues can diminish over time, especially under extremes of temperature, sunlight, moisture and repeated high impact loads. Thus glues are not relied upon in the present invention. A much better and even simpler approach for providing rear anchoring points would be a U-shaped component whose ends attached to the bottom of the headgear's facemask, and whose curved middle section extended back to the rear underside of the headgear. Such a U-shaped component could provide multiple anchor points, principally at the rear of the helmet (but also along its sides), for straps running over the top of the helmet and for straps attached to the side cushion. Finally, since the U-shaped component would always be in tension when installed on the headgear, the component could be a flexible strap. Such a strap, whose ends attach to opposites sides of the lower facemask and whose middle extends back toward the rear underside of the helmet, is, in fact, the ideal apparatus for anchoring other straps at the rear, and along the sides, of the helmet. Such a strap is referred to as the "rear anchor strap." Thus, the rear anchor points lie along the middle half of the anchor strap. A key component of the present invention is the rear anchor strap. The present invention also includes "top anchor straps" whose ends attach to opposite sides of the rear anchor strap, and whose middle sections runs over the top of the hard outer shell, from side to side.

The length of the rear anchor strap must be sized appropriately for it to perform its intended function. The two ends of the rear anchor strap must attach to lower elements on opposite sides of the headgear's facemask to avoid impinging on space where cushions could be mounted on the hard outer shell. After the two ends have been secured to forward lower anchor points, pulling the middle of the rear anchor strap back toward the rear underside of the helmet causes the rear anchor strap to assume a U shape. The free length of the rear anchor strap must be long enough so that the space inside the U is sufficient to avoid contacting the wearer's head and neck, yet short enough to prevent the rear anchor strap from being pulled past the rear edge of the headgear, and onto the rear surface of the hard outer shell. This requirement will be satisfied when the free length of the rear anchor strap is just long enough to follow the elliptically-shaped bottom edge of the hard outer shell when the rear anchor strap is extended unstressed toward the back of the hard outer shell. A rear anchor strap of this length can anchor other straps at the rear, and along the sides of the hard outer shell, thereby obviating the need for clips, hooks, buckles, or adhesives. Thus the rear anchor strap enables cushions to be secured to the outside of the hard outer shell by laying straps over and around the cushions, and anchoring one of each strap's two ends to points located at the rear and sides of the headgear.

Figure 13:
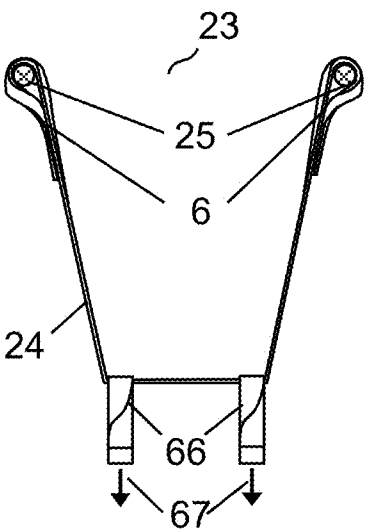
FIG. 13 shows a rear anchor strap whose two ends have been wrapped around anchor points by forming them into twisted loops, and whose middle has been pulled taunt away from the two anchor points.

FIG. 13 shows an assembly 23 consisting of a rear anchor strap 24 whose two free ends have been wrapped around two anchor points 25 by forming the free ends into a first set of twisted loops 6. The rear anchor strap 24 has been pulled taunt by attaching a second set of twisted loops 66 to the middle of the anchor strap 24, and pulling this second set of twisted loops 66 in the direction indicated by the arrows, 67, away from the anchor points 25.

Figure 14:
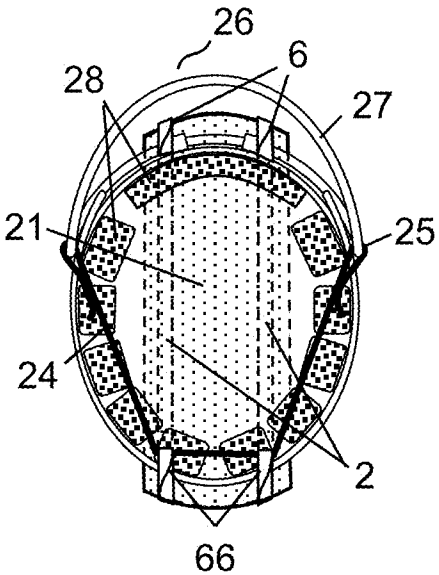
FIG. 14 gives an underside view of a football helmet, equipped with a rear anchor strap, and two lengthwise straps that secures a crown cushion to the helmet, using the face mask for forward anchor points and the anchor strap for rear anchor points.

FIG. 14 gives an underside view of a typical football helmet 26, equipped with a rear anchor strap 24, and two lengthwise straps 2 that secure a crown cushion 21 to the football helmet 26, using the face mask 27 for forward anchor points and the rear anchor strap 24 for rear anchor points. The lengthwise straps 2 have their forward ends formed into twisted loops 6, which secures the forward ends to the facemask 27. Similarly, the straps 2 rear ends are formed into twisted loops 66, which secure them to the rear anchor strap 24. The ends of the rear anchor strap 24 are attached to the rearmost posts 25 of the facemask 27, on opposite sides of the helmet 26. As FIG. 14 shows, the length of the rear anchor strap 24 and the distance between the two lengthwise straps 2 have been selected to avoid impinging into the space reserved for the wearer's head and neck, defined by the inner perimeter of the array of cushions 28.

Figure 15:
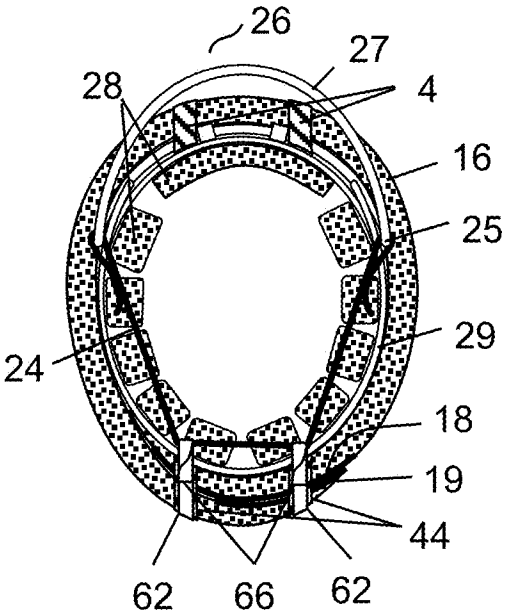
FIG. 15 gives an underside view of a side cushion mounted onto a football helmet using a rear anchor strap, overlapping loops, and connector straps having twisted loops.

FIG. 15 gives an underside view of a side cushion 16 mounted onto a football helmet's 26 hard outer shell 29 using a rear anchor strap 24, overlapping straps 4 and 44, and connector straps 62 possessing twisted loops 66. The forward overlapping straps 4 wrap around the forward section of the side cushion 16 and a horizontal member of the facemask 27. The rear set of overlapping straps 44 only wrap around the rearmost section of the side cushion 16, and serve as anchor points for the two connector straps 62 having twisted loops 66. The two twisted loops 66 wrap around the rear anchor strap 24 and draw the rear anchor strap 24 taunt toward the rear of the hard outer shell 29. The remaining two free ends of the two connector straps 62 attach to the overlapping straps 44. The free ends of the connector straps 62 having one end terminated in a twisted loop 66 are oriented in a way that allows their hooks or loops to engage the mating hooks or loops on the outer surface of the overlapping straps 44. The two mating patches of hook and loop material 18 and 19 are shown engaging one another in the area where the two ends of the side cushion 16 overlap. The most natural point for the two ends to overlap is at the rear of the football helmet 26 to protect against the football helmet 26 bouncing off the ground. However, the wearer is free to choose any point around the perimeter of the hard outer shell 29 as the overlap point.

Summarizing, the crown cushion, arc cushions, and side cushion are held in place by four types of straps: (1) "anchor straps" that provide anchor points for other straps and cushions; (2) "lengthwise straps" that run parallel to the long side of the elongated rectangular-shaped cushions; (3) "overlapping loops" that wrap around the cushions in a direction parallel to the short side of the elongated rectangular-shaped cushions, and (4) "connector straps" that either connects two straps together, or connects another strap to an anchor point. The two ends of the rear anchor strap attach to lower forward anchor points on opposite sides of the hard outer shell, and the middle of the rear anchor strap extends backwards along the underside of the helmet.

Figure 16:
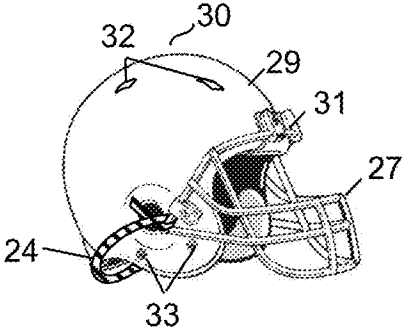
FIG. 16 shows a typical football helmet with a rear anchor strap attached to the facemask and with two visible chin strap lugs.

FIG. 16 shows a typical football helmet 30 with a rear anchor strap 24 attached to the facemask 27 and two visible chin strap lugs 33. Two ventilation holes 32 are also visible, along with a horizontal member of the facemask 31. The horizontal member of the facemask 31 can serve as forward anchor points for the lengthwise straps 2 depicted in FIG. 14.

FIG. 17 gives a perspective view of a football helmet 34 equipped with a side cushion 16 and a rear anchor strap 24. The side cushion 16 is wrapped with two sets of overlapping loops 4 and 44 at the front and rear of the football helmet 34, respectively. One each of overlapping loops 4 and 44 are visible in FIG. 17. The side cushion 16 is attached at the rear of the football helmet 34 by means of two connector straps 62 whose first ends wrap around the rear anchor strap 24 via twisted loops 66 and whose second ends latch onto an overlapping loop 44 to produce a loop-and-strap-assembly 5. The side cushion 16 is attached to the front end of the football helmet 34 by two overlapping loops 4 (only one of which is visible) that surround the side cushion 16 and a horizontal member of the facemask 31.

Figure 18:
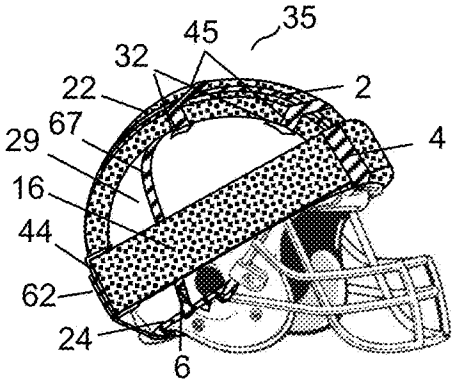
FIG. 18 gives a perspective view of a side cushion and a top cushion mounted onto a football helmet using a rear anchor strap, overlapping loops, and lengthwise straps having twisted loops.

FIG. 18 gives a perspective view of a football helmet 35 equipped with both a side cushion 16 and a top cushion assembly 22. The top cushion assembly 22 consists of at least one set of lengthwise straps that run over the top sides of a set of at least one top cushion from end to end, wherein the length of every top cushion in the set of at least one top cushion allows it to fit snugly in the space available between the rear and front of the installed side cushion. The side cushion 16 is mounted to the football helmet 35 with the same components depicted in FIG. 17. The crown cushion assembly 22 simply adds to the structure depicted in FIG. 17. Specifically, the top cushion assembly 22 covers the portion of the crown of the hard outer shell 29 not already covered by the side cushion 16. Dual lengthwise straps 2 run from front to back over the top cushion assembly 22 and force the top cushion assembly 22 to conform to the shape of the hard outer shell 29. The front ends of the lengthwise straps 2 latch onto overlapping loops 4 at the front of the football helmet 35. The rear ends of the lengthwise straps latch onto overlapping loops 44 at the rear of the football helmet 35. A third set of overlapping loops 45 keep the top cushion assembly 22 centered on the top of the hard outer shell 29 by threading the overlapping loops 45 through existing vent holes 32 near the top of the hard outer shell 29. A top anchor strap 67 whose two ends attach to the rear anchor strap 24 by means of twisted loops 6 (only one of which is visible) is also available to help stabilize the to cushion assembly 22 atop the hard outer shell 29. The top anchor strap 67 may further stabilize the top cushion assembly 22 by engaging an overlapping loop (not shown) that wraps around the minor cross section of the top cushion assembly 22 to form a loop-and-strap-assembly, for example.

FIG. 19 gives a frontal view of a football helmet 36 protected by only a crown cushion 21. The crown cushion 21 is secured to the hard outer shell 29 by lengthwise straps 2. The front ends of the lengthwise straps 2 are anchored to a horizontal member of the face mask 31 using a twisted loop 6. The rear end of the straps 2 are secured to the rear of the hard outer shell by means of twisted loops (not visible in FIG. 19) that wrap around an anchor strap (also not visible in FIG. 19), as depicted in FIG. 14. An overlapping loop 45 runs through two existing holes (not visible) near the top of the hard outer shell 29 and wraps over the crown cushion 21 to keep the crown cushion 21 centered on the top of the hard outer shell 29.

FIG. 20 gives a perspective view of a side cushion 16 and a crown cushion 21 mounted onto a football helmet 37 using an anchor strap (not visible), overlapping loops 4 and 45, and lengthwise straps 2 whose front ends latch onto the overlapping loops 4 that wrap around the front end of the side cushion 16 and a horizontal member of the face mask 31. The latching of the ends of the lengthwise straps 2 to the overlapping loops 4 produces a loop-and-strap-assembly 5. The rear ends of the lengthwise straps 2 are not visible in FIG. 20, but latch onto overlapping loops 44 (also not visible) as depicted in FIG. 15. The configuration depicted in FIG. 20 allows the crown cushion 21 to be removed from the football helmet 37 without affecting the side cushion 16.

FIG. 21 shows a crown cushion 21 and two arc cushions 39 that run from back to front over the top half of the hard outer shell 29 of the protective headgear 38, and which are stabilized on the headgear's 38 hard outer shell 29 by a friction patch 40. The crown cushion 21 and the two arc cushions 39 are anchored to the hard outer shell 29 by means of three lengthwise straps 2 that run over their tops. The lengthwise straps 2 are anchored at the front and rear of the headgear 39 by means of twisted loops 6. The front anchor point is a horizontal element 31 of the facemask 27. The friction patch 40 is a sheet having a high coefficient of friction on both sides. For example, the side that contacts the hard outer shell 29 may have a coefficient of friction similar to that of carpet tape, while the side that contacts the crown cushion 21 and arc cushions 39 may have a coefficient of friction similar to that of sandpaper. The friction patch 40 does not anchor the crown cushion 21 and arc cushions 39 to the hard outer shell 29, but rather merely inhibits their lateral movements. Although FIG. 21 depicts just two arc cushions 39. However, others may be added, limited only by the space available on the headgear's 38 hard outer shell 29. The combination of the crown cushion 21, arc cushions 39, and side cushion 16 depicted in FIG. 20 can completely protect the headgear 38.

Numerous modifications to and alternative embodiments of the present invention will be apparent to those skilled in the art in view of the foregoing description. Accordingly, this description is to be construed as illustrative only, and is for the purpose of teaching those skilled in the art the best modes of carrying out the invention. Details of the system may be varied substantially without departing from the spirit of the invention and the exclusive use of all modifications which come within the scope of the appended claims is reserved.

What I claim as my invention is:

1. A method of placing a plurality of self-engaging straps having opposing free ends about a helmet possessing a hard outer shell without extending beyond the bottom peripheral edge of the hard outer shell to contact the head or neck of the wearer with an elongated rectangular side cushion having overlapping tapered ends that completely wraps around the side of the hard outer shell that are fastened together by hook and loop material in combination with elongated rectangular top cushions that are positioned substantially along the middle of the hard outer shell and ends of the top cushions are anchored at rear and front of the hard outer shell and held in position relative to the helmet by the plurality of self-engaging straps.

2. A method according to claim 1 that lacks the rectangular side cushion.

3. A method according to claim 1 that lacks and elongated rectangular top cushions.

4. A protective headgear for reducing the severity of blows to the head of a user that consists of a plurality of self-engaging straps having opposing free ends that attach to a helmet possessing a hard outer shell without extending beyond the bottom peripheral edge of the hard outer shell to contact the head or neck of the wearer with an elongated rectangular side cushion having overlapping tapered ends that completely wraps around the side of the hard outer shell that are fastened together by hook and loop material in combination with elongated rectangular top cushions that are positioned substantially along the middle of the hard outer shell and ends of the top cushions are anchored at rear and front of the hard outer shell and held in position relative to the helmet by the plurality of self-engaging straps.

5. A protective headgear for reducing the severity of blows to the head of a user according to claim 4 that lacks the elongated rectangular side cushion.

6. A protective headgear for reducing the severity of blows to the head of a user according to claim 4 that lacks the elongated rectangular top cushions.

* * * * *